US006393631B2

(12) United States Patent
Schroader

(10) Patent No.: US 6,393,631 B2
(45) Date of Patent: May 28, 2002

(54) DRAIN SAFETY COVER SYSTEM AND METHOD

(76) Inventor: Ronald Schroader, 3915 Adcock La., Lake Worth, FL (US) 33461

( * ) Notice: Subject to any disclaimer, the term of this patent is extended or adjusted under 35 U.S.C. 154(b) by 0 days.

(21) Appl. No.: 09/858,755

(22) Filed: May 16, 2001

Related U.S. Application Data

(60) Provisional application No. 60/204,413, filed on May 16, 2000.

(51) Int. Cl.[7] ..... E04H 4/12

(52) U.S. Cl. ..... 4/504; 4/292; 4/507

(58) Field of Search ..... 4/504, 507, 286, 4/292, 509; 210/163

(56) References Cited

U.S. PATENT DOCUMENTS

| | | | | | |
|---|---|---|---|---|---|
| 1,791,512 | A | * | 2/1931 | Schurman | 210/163 |
| 3,940,807 | A | | 3/1976 | Baker et al. | 4/504 X |
| 4,170,047 | A | | 10/1979 | Corsette et al. | 4/292 X |
| 4,596,656 | A | | 6/1986 | Higginbotham et al. | 4/292 X |
| 4,602,391 | A | | 7/1986 | Shepherd | 4/504 X |
| 4,658,449 | A | | 4/1987 | Martin | 4/504 X |
| D319,295 | S | | 8/1991 | Ohaus | D23/261 |
| D333,342 | S | | 2/1993 | Newhard | 4/507 X |
| 5,347,664 | A | | 9/1994 | Hamza et al. | 4/509 |
| 5,499,406 | A | | 3/1996 | Chalberg et al. | 4/504 X |
| 5,734,999 | A | | 4/1998 | Nicholas | 4/507 |
| 5,799,339 | A | | 9/1998 | Perry et al. | 4/286 |
| 5,809,587 | A | | 9/1998 | Fleischer | 4/504 |
| 5,822,807 | A | | 10/1998 | Gallagher et al. | 4/507 |
| 5,978,981 | A | | 11/1999 | Nelson | 4/504 X |
| 6,230,337 | B1 | * | 5/2001 | Barnett | 4/507 |
| 6,308,350 | B1 | * | 10/2001 | Marchionda | 4/292 X |

* cited by examiner

*Primary Examiner*—Robert M. Fetsuga
(74) *Attorney, Agent, or Firm*—Akerman Senterfitt

(57) ABSTRACT

A pool drain safety cover system and method. The system includes a base defining at least one primary fluid aperture and a plurality of secondary fluid apertures. The cover also includes a grating extending across at least the primary fluid aperture for permitting the passage of drain water therethrough. The grating has at least an upper and a lower layer. The upper and lower layers are adjacent, and each is comprised of a plurality of spaced ribs for permitting the passage of fluid in a clearance space between the ribs.

12 Claims, 5 Drawing Sheets

DRAIN SAFETY COVER SYSTEM AND METHOD

CROSS REFERENCE TO RELATED APPLICATIONS

This application claims the benefit of U.S. Patent Provisional Application No. 60/204,413, filed on May 16, 2000.

STATEMENT REGARDING FEDERALLY SPONSORED RESEARCH OR DEVELOPMENT (Not Applicable)

BACKGROUND OF THE INVENTION

1. Field of the Invention

The present invention relates generally to drainage systems located on the bottom or along the side of a swimming pool or spa. More particularly, the invention relates to a method and apparatus for preventing the entrapment of a person in the drain of a swimming pool or spa.

2. Description of the Related Art

Swimming pools and spas typically have systems for draining and recirculating water. Such systems usually have a main drain or sump located at or near the bottom of the swimming pool or spa. Water is normally suctioned out of the swimming pool or spa through the main drain, into an inlet of a suction pump, and then drained or recirculated back into the swimming pool or spa through jets located around the interior wall of the swimming pool or spa.

When bathers place their heads or bodies in the vicinity of an active drain, their hair or a portion of their body may become entrapped in a portion of the drain, such as a cover or grating. A sealed drain can develop a strong vacuum within a few seconds. If the vacuum pressure is strong enough, a bather who is entrapped by a drain may not be able to break free of the vacuum and may ultimately drown.

Swimming pool and spa safety organizations, such as the United States Consumer Product Safety Commission (CPSC), the National Spa and Pool Institute (NPSI), and various state government entities, have acknowledged the need for devices that protect against swimming pool and spa drain entrapment. Of particular concern are entrapments involving hair entanglement, limb entrapment, body entrapment, and disembowelment. Hair entanglement occurs when a bather dips below a water surface and his or her hair is sucked into and becomes entangled on a drain grate on the main drain of a swimming pool or spa. Body entrapment typically occurs when part of a bather's torso completely covers an unprotected or damaged drain, thereby creating a vacuum within the drain from which the bather cannot break free. Limb entrapment refers to accidents in which a bather's arm or leg is sucked into a main drain of a swimming pool or spa. Disembowelment accidents occur where small children, usually three to six years old, sit on a drain. Injury occurs when their lower intestines are sucked out of their body through their anus.

Various devices have been used to prevent entrapment. For example, swimming pools and spa have been provided with multiple drains, as opposed to just a single drain, to prevent a vacuum from being formed when one of the drains is obstructed. A system with multiple drains has its drawbacks, however, in that it can be significantly more expensive. Additionally, multiple bathers can cover the multiple drains, permitting the creation of the hazardous vacuum which the system is designed to prevent.

Pressure detection systems have also been used to reduce the risk of entrapment. Pressure detection systems shut off a drain system when the vacuum pressure within the system reaches a critical level. Unfortunately, the complexity of such systems raises reliability concerns. Thus, a need still exists for an improved method and apparatus for preventing entrapment.

SUMMARY OF THE INVENTION

One aspect of the present invention relates to a pool drain safety cover. The cover includes a base defining at least one primary fluid aperture and a plurality of secondary fluid apertures. The cover also includes a grating extending across at least the primary fluid aperture for permitting the passage of drain water therethrough. The grating has at least an upper layer and a lower layer. The upper and lower layers are adjacent, and each is comprised of a plurality of spaced ribs for permitting the passage of fluid in a clearance space between the ribs.

Another aspect of the invention relates to a method for providing a pool drain safety cover. The method includes providing a base defining at least one primary fluid aperture and a plurality of secondary fluid apertures. The method also includes positioning across at least the primary fluid aperture a grating for permitting the passage of drain water therethrough. The grating includes at least an upper layer and a lower layer. The upper and lower layers are adjacent, and each includes a plurality of spaced ribs for permitting the passage of fluid in a clearance space between the ribs.

According to either aspect of the invention, the ribs of the upper layer can be perpendicular to the ribs of the lower layer. The spacing between the ribs can be between approximately one-eighth inch and one-sixteenth inch. The base can include a perimeter portion surrounding the primary fluid aperture, and a plurality of protrusions extending from an underside of the perimeter portion. Adjacent pairs of the plurality of protrusions can define the secondary fluid apertures. A tip portion of the protrusions can extend radially beyond the perimeter portion. The tip portion can have a smoothly contoured curved face.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE PREFERRED EMBODIMENTS

Figure 1:
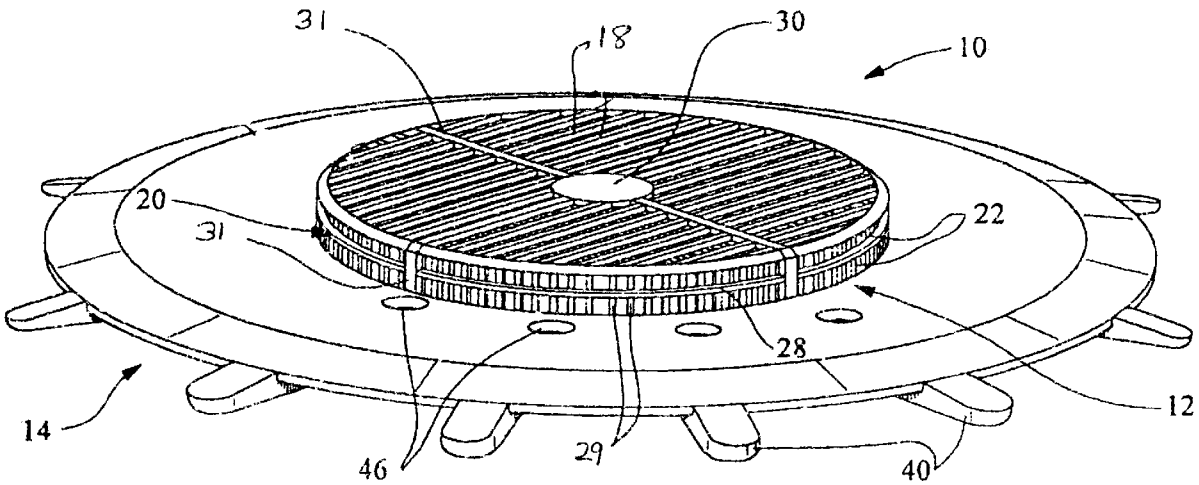
FIG. 1 is a perspective view of a drain safety cover according to the invention.

FIG. 1 shows a drain safety cover 10 according to the present invention. The cover 10 can be positioned over a pool drain to prevent bathers from being trapped by the suction of the drain. The cover 10 includes a grating 12. The cover 10 can also include a base 14 for receiving the grating 12.

Figure 3:
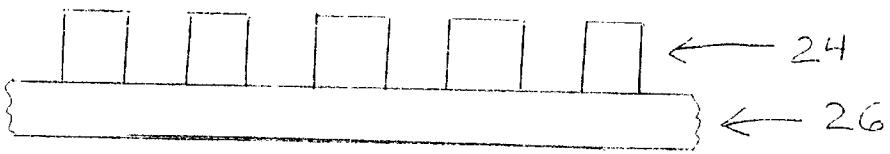
FIG. 3 is an enlarged cross-sectional view of the cover of FIG. 1, taken along the line 3—3 in FIG. 2.
Figure 2:
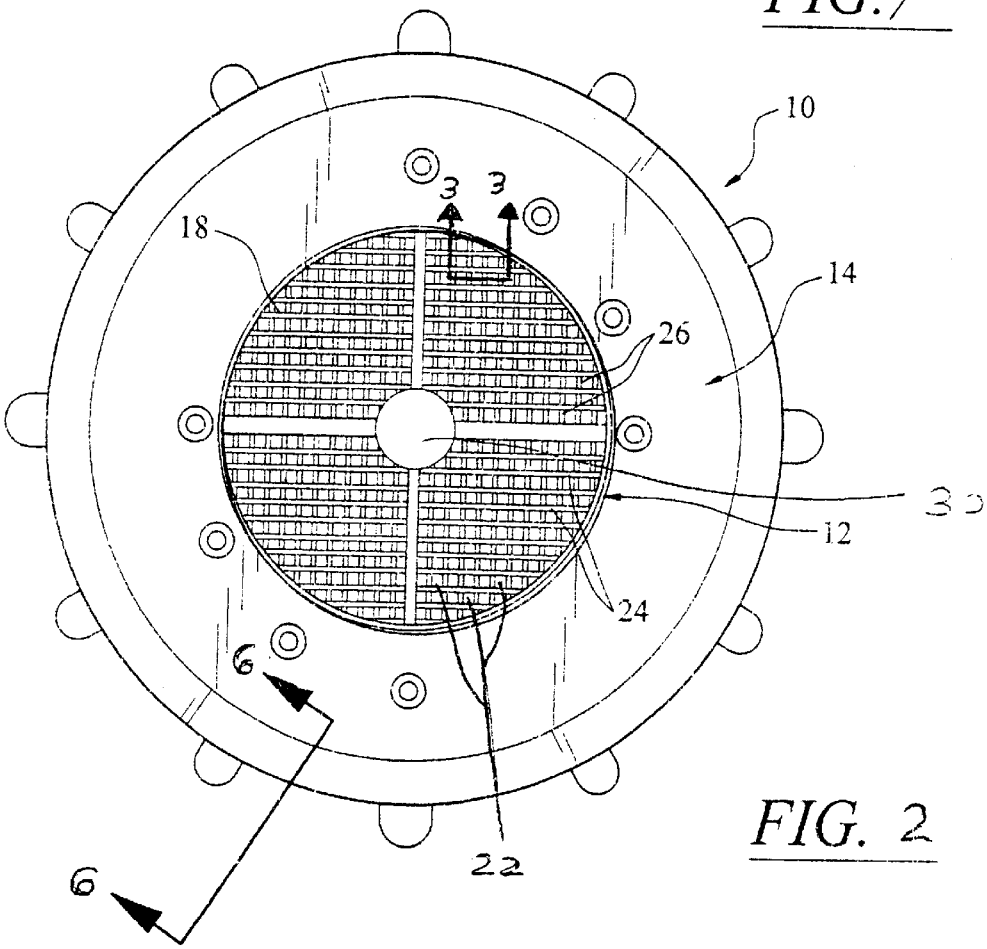
FIG. 2 is a top view of the cover of FIG. 1.

The grating can have a top portion 18 and a side portion 20. As shown in FIG. 2, the top portion 18 can have at least one upper layer of spaced ribs 24 and at least one lower layer of spaced ribs 26. The ribs within the upper layer 24 and lower layer 26 can extend partially or completely across the top portion 18. The upper layer 24 and the lower layer 26 are preferably adjacent to each other, as shown in FIG. 3. The upper layer 24 and the lower layer 26 define a clearance space 22 through which fluid can pass.

As shown in FIG. 3, the ribs in the upper layer 24 are preferably substantially parallel to each other. The ribs in the lower layer 26 are also preferably substantially parallel to each other. In addition, the ribs in the upper layer 24 are preferably substantially perpendicular to the ribs in the lower layer 26. It should be understood that the invention is not limited to these particular orientations, however, as any suitable angles of orientation are acceptable.

Referring again to FIG. 1, the side portion 20 of the grating 12 can include at least one upper layer of one or more ribs 28, and at least one lower layer of one or more ribs 29. The upper layer 28 and the lower layer of 29 can be adjacent to each other, and the upper layer 28 and the lower layer 29 can each have clearance space 22 through which fluid can pass. The ribs in the upper and lower layers 28, 29 of the side portion 20 can extend partially or completely across the side portion 20. The ribs in the upper and lower layers 28, 29 of the side portion 20 can be oriented in the same manner as the ribs in the upper and lower layers 24, 26 of the top portion 18. Thus, the ribs in the upper layer 28 can be substantially parallel to each other, the ribs in the lower layer 29 can be preferably substantially parallel to each other, and the ribs in the upper layer 28 can be substantially perpendicular to the ribs in the lower layer 29. It is understood that the invention is not limited to these parallel and perpendicular orientations, however, as any other suitable angles of orientation are also acceptable.

Positioning the upper and lower layers of the top portion 18 and/or the upper and lower layers of the side portion 20 in the orientations described above has been found to provide distinct advantages over the prior art. Specifically, hair which is placed in the vicinity of the grating 12 can be substantially or entirely prevented from entering the clearance space 22. Consequently, such a design can prevent hair entanglements and thereby protect individuals from being trapped by the suction of a drain covered by the cover 10. Notably, however, a cover 10 in accordance with the inventive arrangements will not significantly interfere with the flow of fluid through the cover 10.

In one arrangement, the ribs in the upper and lower layers 24, 26 of the top portion 18 and the ribs in the upper and lower layers 28, 29 of the side portion 20 can be spaced approximately one-sixteenth inch apart, approximately one-eighth inch apart, or between approximately one-eighth inch and approximately one-sixteenth inch apart. It should be noted, however, that the invention is not limited to these particular dimensions, as other suitable dimensions are also acceptable.

In addition, the top portion 18 of the grating 12 can have a plate 30. In one arrangement, the plate 30 can be a section of the top portion 18, and can be substantially centrally located on the top portion 18. Further, the plate 30 can have a perimeter that is less than the perimeter of the top portion 18 so as not to substantially interfere with the flow of fluid through the grating 12. Including a plate 30 with the grating 12 can provide extra support to the grating 12, as the plate 30 can provide a solid surface over a portion of the grating 12.

In another arrangement, any layer of the grating 12 can include one or more ribs 31 having a thickness greater than the remaining ribs, where the greater thickness reduces the spacing between the ribs within the layer. Including one or more thicker ribs 31 in one or more of the layers of the grating 12 can provide extra support to the cover 10, and can help the cover 10 absorb collisions or impacts. Although FIG. 1 shows the grating 12 as having two thicker ribs 31, it should be noted that the invention is not limited to this particular arrangement.

Figure 4:
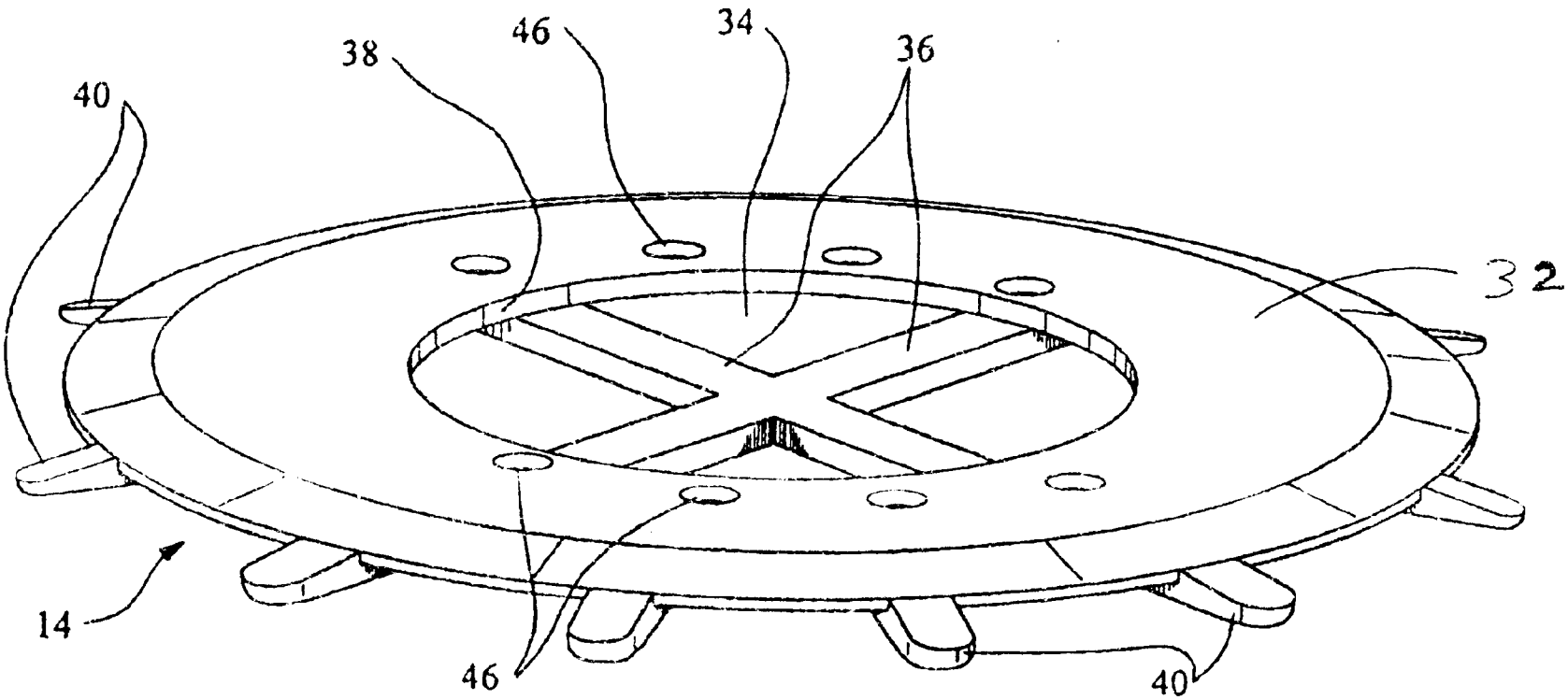
FIG. 4 is a perspective view of a base of FIG. 1.

As previously indicated, the invention can also include a base 14. FIG. 4 shows an example of a suitable base 14. Although FIG. 4 shows the base 14 as having a circular shape, the invention is not so limited, as the base 14 can be any other suitable shape capable of receiving the grating 12 and covering a drain. The base 14 can have a perimeter portion such as a ring 32, which can enlarge the size of the cover 10 and possibly further reduce the risk of entrapment or injury. The ring 32 can define a primary fluid aperture 34 through which fluid can flow from the grating 12 to a drain.

The base 14 can have one or more support members 36 extending partially or completely across the primary fluid aperture 34 upon which the grating 12 can be seated. Alternatively, one or more projections (not shown) placed along an inner perimeter 38 of the primary fluid aperture 34 can be used to support the grating 12.

For purposes of holding the grating 12 in place, the perimeter of the side portion 20 of the grating 12 can be substantially equivalent to the inner perimeter 38 of the primary fluid aperture 34 of the base 14. Such an arrangement can provide a snug fit between the grating 12 and the base 14. The invention, however, is not limited to this particular arrangement, as any other suitable structure or process can be used to secure the grating 12 to the base 14. For example, the grating 12 and the base 14 can be constructed as one component in which the grating 12 can be secured to the base 14 during the manufacturing process.

Figure 5:
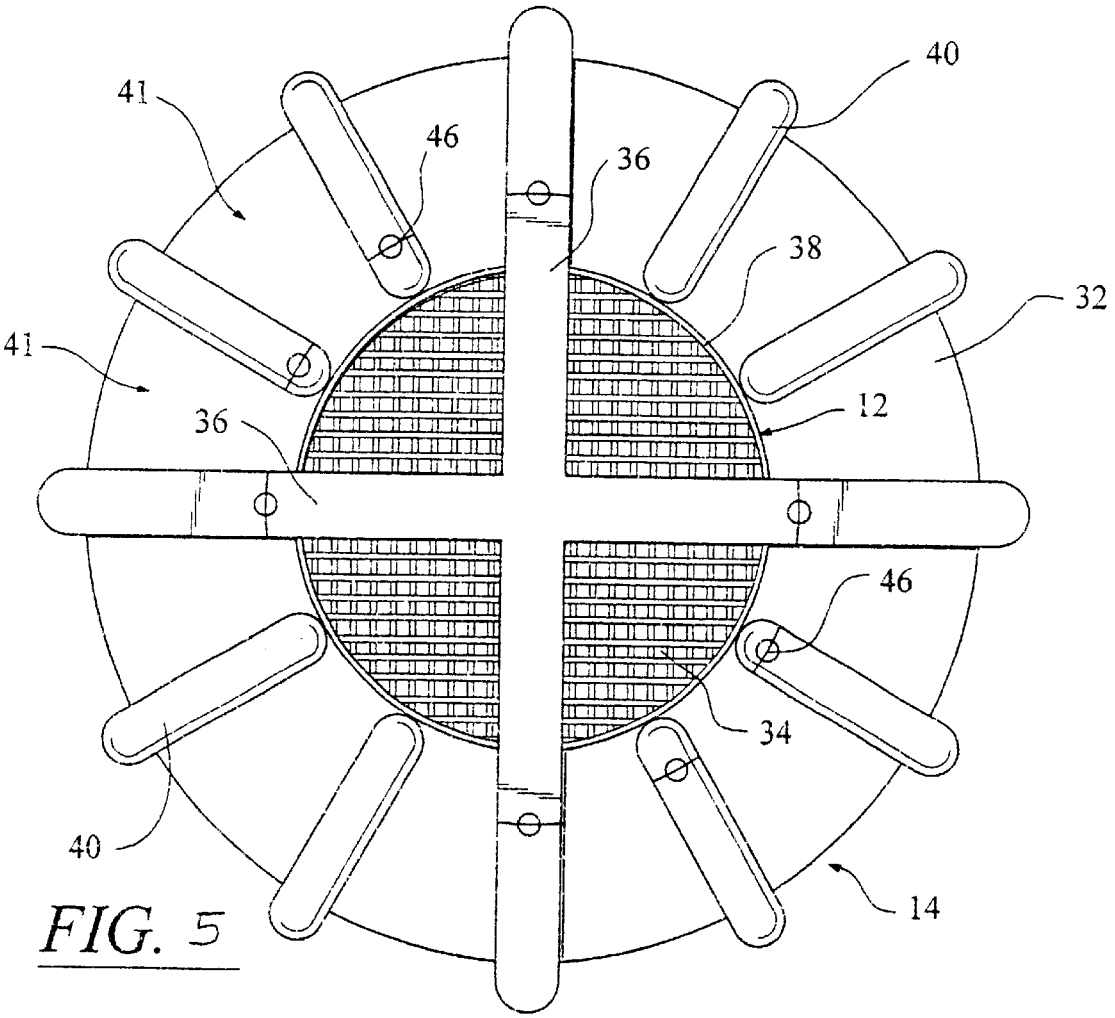
FIG. 5 is a bottom view of the cover of FIG. 1.

Referring to FIG. 5, the base 14 can have one or more protrusions 40 which can be arranged radially about the underside of a perimeter portion such as a ring 32. The protrusions 40 can define a plurality of radially spaced secondary fluid apertures 41 beneath the ring 32 for ensuring an unimpeded fluid flow path in the event that an obstruction is placed over the grating 12. In one arrangement, most of the protrusions 40 do not extend beyond the inner perimeter 38 of the primary fluid aperture 34 of the base 14 so as not to interfere with the fluid flowing through the grating 12. One or more of the protrusions 40, however, can be extended across the primary fluid aperture 34, for example to form the support members 36 for supporting the grating 12.

Figure 6:
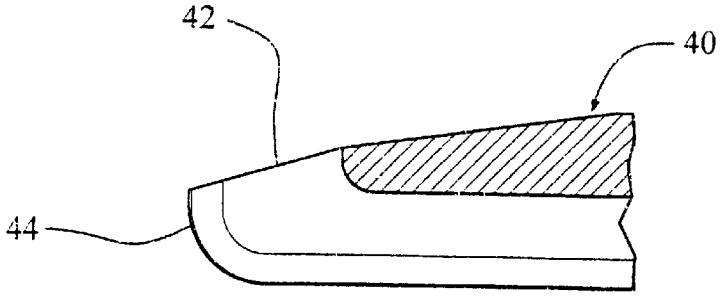
FIG. 6 is an enlarged cross-sectional view of a portion of a protrusion attached to the base of FIG. 2, taken along line 6—6 in FIG. 2.

The ends of one or more of the protrusions 40 can be rounded or tapered. The invention, however, is not so limited, as the protrusions 40 can be any suitable shape. FIG. 6 shows a suitable protrusion 40, in which a top surface 42 of the protrusion 40 can be tapered such that the top surface 42 slopes substantially downwards towards an end 44 of the protrusion 40. In addition, the top surface 42 and the end 44 can be rounded. The upper layers 26 of the grating 12 can be positioned above, below, or at the same level as the uppermost surface of the ring 32. In one arrangement (not shown), a section of the side portion 20 of the grating 12 can extend below the underside of the ring 32 SO that fluid flowing through secondary fluid apertures 41 can also pass through the side portion 20.

Figure 7:
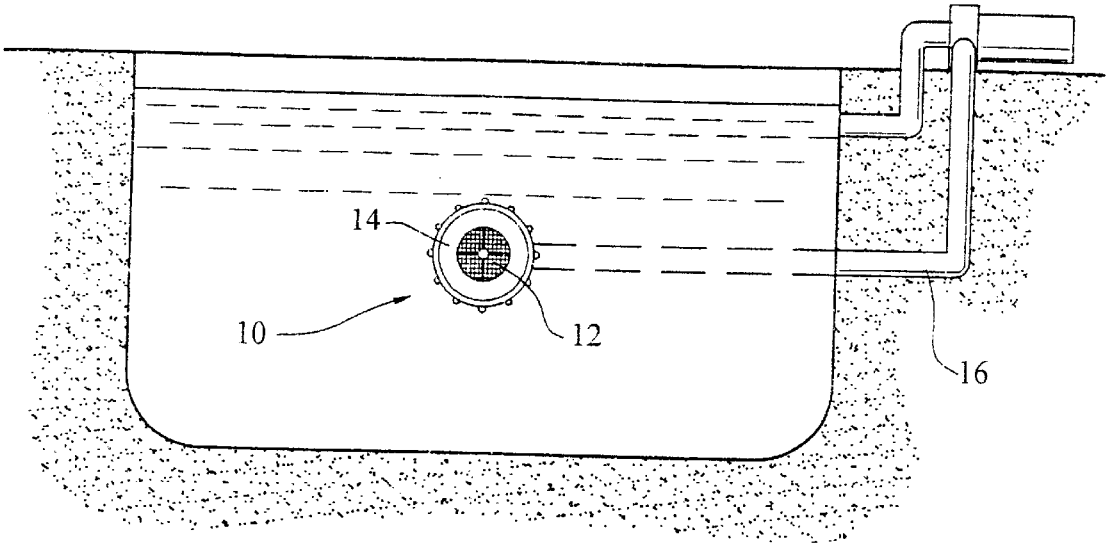
FIG. 7 shows the cover of FIG. 1 positioned over a drain.
Figure 8:
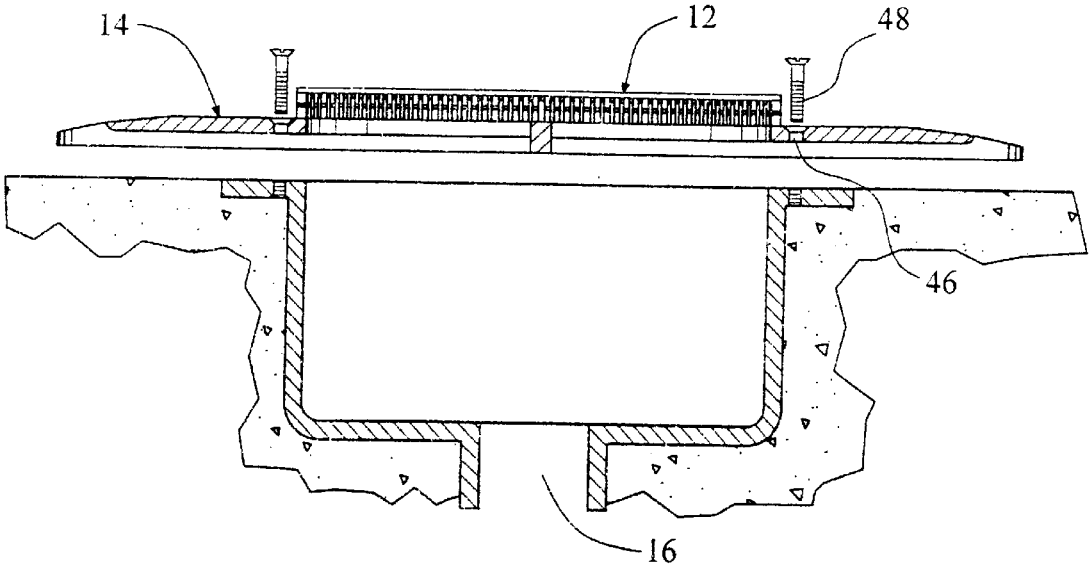
FIG. 8 is a cross-sectional view of the cover of FIG. 1 attached to a drain.

FIG. 7 shows the cover 10 attached to a drain 16. The cover 10 may be attached to a drain 16 in any suitable manner. For example, a portion of the cover 10 may be mounted to the drain 16 with any suitable mechanical or chemical fastening structure, such as screws, bolts, nails, or adhesive. To receive such a suitable fastening structure, one or more holes 46 can be provided in the ring 32 of the base 14, as shown in FIG. 4. Although FIG. 4 shows the base 14 as containing eight holes 46, the invention is not limited to this particular embodiment, as the base can contain any suitable number of holes 46. As shown in FIG. 5, the holes 46 can be positioned on the base 14 such that the holes 46 pass through one or more protrusions 40. Such an arrangement can provide extra support to the base 14, as a greater portion of the base 14 can be engaged by the suitable fastening structure inserted into the holes 46. Notably, however, the invention is not limited in this regard, as the holes 46 can be located at any other suitable location on the base 14. FIG. 8 shows one or more fasteners 48 being inserted into the holes 46 to secure the cover 10 to the drain 16.

Figure 9:
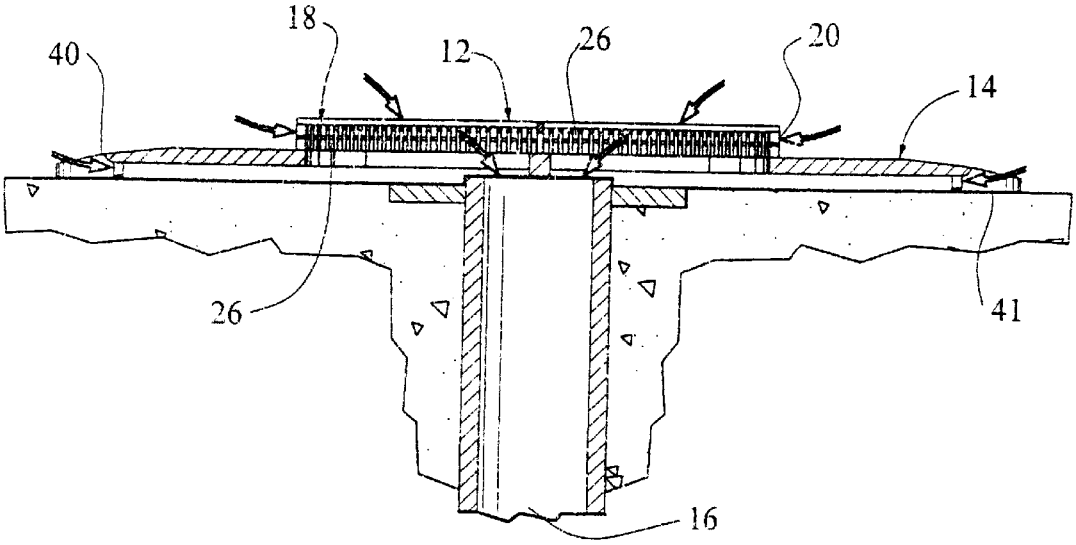
FIG. 9 is a cross-sectional view of the cover of FIG. 1 positioned over a drain, illustrating how fluid can flow through the cover prior to entering the drain.

FIG. 9 shows the path of fluid through the grating 12 and the base 14. Fluid can enter the top portion 18 of the grating and can pass through the upper layers 26 of the grating (not shown) before entering the drain 16. Further, fluid can enter and pass through the side portion 20 of the grating 12 before entering the drain 16. Fluid can also pass through the secondary fluid apertures 41 formed by the protrusions 40 and, if so desired, can pass through a section of the side portion 20 before the fluid enters the drain 16. The arrangement illustrated in FIG. 9 can prevent a bather from being trapped by the low pressure area created by the drain 16, yet does not significantly interfere with the flow of fluid through the grating 12 and the base 14.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A pool drain safety cover, comprising:

a base defining at least one primary fluid aperture and a plurality of secondary fluid apertures;

a grating extending across at least said primary fluid aperture for permitting the passage of drain water therethrough;

said grating comprised of at least an upper and a lower layer, said upper and lower layers adjacent, and each comprised of a plurality of spaced ribs for permitting the passage of fluid in a clearance space between said ribs.

2. The pool drain safety cover of claim 1, wherein said ribs of said upper layer are perpendicular to said ribs of said lower layer.

3. The pool drain safety cover of claim 1, wherein said spacing between said ribs is between approximately one-eighth inch and one-sixteenth inch.

4. The pool drain safety cover of claim 1, wherein said base is comprised of a perimeter portion surrounding said primary fluid aperture and a plurality of protrusions extending from an underside of said perimeter portion.

5. The pool drain safety cover of claim 4, wherein adjacent pairs of said plurality of protrusions define said secondary fluid apertures.

6. The pool drain safety cover of claim 4, wherein a tip portion of said protrusions extend radially beyond said perimeter portion, said tip portion having a smoothly contoured curved face.

7. A method for providing a pool drain safety cover, comprising the steps of:

providing a base defining at least one primary fluid aperture and a plurality of secondary fluid apertures; and positioning across at least said primary fluid aperture a grating for permitting the passage of drain water therethrough, said grating comprised of at least an upper and a lower layer, said upper and lower layers adjacent, and each comprised of a plurality of spaced ribs for permitting the passage of fluid in a clearance space between said ribs.

8. The method of claim 7, wherein said ribs of said upper layer are perpendicular to said ribs of said lower layer.

9. The method of claim 7, wherein said spacing between said ribs is between approximately one-eighth inch and one-sixteenth inch.

10. The method of claim 7, wherein said base is comprised of a perimeter portion surrounding said primary fluid aperture and a plurality of protrusions extending from an underside of said perimeter portion.

11. The method of claim 10, wherein adjacent pairs of said plurality of protrusions define said secondary fluid apertures.

12. The method of claim 10, wherein a tip portion of said protrusions extend radially beyond said perimeter portion, said tip portion having a smoothly contoured curved face.

* * * * *